US007216470B2

(12) United States Patent
Nishida

(10) Patent No.: US 7,216,470 B2
(45) Date of Patent: May 15, 2007

(54) SHEET PACKAGE PRODUCING SYSTEM

(75) Inventor: Hiroyuki Nishida, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 52 days.

(21) Appl. No.: 10/042,381

(22) Filed: Jan. 11, 2002

(65) Prior Publication Data

US 2002/0092277 A1 Jul. 18, 2002

(30) Foreign Application Priority Data

Jan. 12, 2001 (JP) ..... 2001-005322

(51) Int. Cl.
*B65B 63/00* (2006.01)
*B65B 35/30* (2006.01)

(52) U.S. Cl. ..... 53/520; 53/540; 53/170; 53/157

(58) Field of Classification Search ..... 53/540, 53/520, 170, 157, 550
See application file for complete search history.

(56) References Cited

U.S. PATENT DOCUMENTS 4,028,864 A * 6/1977 Bell ..... 53/438
4,561,235 A * 12/1985 Yanagisawa et al. ..... 53/411
4,610,125 A * 9/1986 Meives et al. ..... 53/462
4,779,401 A * 10/1988 Pedersen ..... 53/520
4,927,322 A * 5/1990 Schweizer et al. ..... 414/794.7
4,939,888 A * 7/1990 Katz et al. ..... 53/411
5,070,677 A * 12/1991 Hicks ..... 53/435
5,353,576 A * 10/1994 Palamides et al. ..... 53/540
5,568,717 A * 10/1996 Harrod ..... 53/429
5,733,099 A * 3/1998 Honneger ..... 414/788
5,771,658 A * 6/1998 Olson et al. ..... 53/157
5,816,030 A * 10/1998 Carlberg et al. ..... 53/520
5,878,554 A * 3/1999 Loree et al. ..... 53/540
6,305,728 B1 * 10/2001 Holter et al. ..... 294/3
6,612,100 B1 * 9/2003 Morimoto et al. ..... 53/540
6,619,014 B2 * 9/2003 Muller ..... 53/399
2004/0020167 A1 * 2/2004 Bertuzzi et al.

FOREIGN PATENT DOCUMENTS

JP 5-51021 3/1993

* cited by examiner

*Primary Examiner*—Scott A. Smith
*Assistant Examiner*—Gloria R. Weeks
(74) *Attorney, Agent, or Firm*—Sughrue Mion, PLLC

(57) ABSTRACT

A sheet package producing system for producing a sheet package having a predetermined number of sheets or X-ray films is provided. A cutting/stacking device forms the sheets by cutting continuous sheet at a regular length, and for stacking the sheets in the predetermined number. A covered sheet stack producing device inserts the stacked sheets into a protective cover, to obtain a covered sheet stack. A packaging device packages the covered sheet stack to obtain the sheet package. The cutting/stacking device, the covered sheet stack producing device and the packaging device are connected in series with one another. Those devices are balanced in line capacity balance relative to one another. In a preferred embodiment, the cutting/stacking device includes a supply module for feeding the continuous sheet. A cutter module cuts the continuous sheet to obtain the sheets. A stacker module stacks the sheets in the predetermined number.

17 Claims, 11 Drawing Sheets

SHEET PACKAGE PRODUCING SYSTEM

BACKGROUND OF THE INVENTION

1. Field of the Invention

The present invention relates to a sheet package producing system. More particularly, the present invention relates to a sheet package producing system for producing a sheet package having a stack of sheets at a low cost and in a manner with compatibility to various sheet types.

2. Description Related to the Prior Art

X-ray films, printing sheets or other products of a sheet shape are shipped in a form of a sheet package by stacking those in a plurality. For example, continuous photosensitive material to be the X-ray film is prepared in a roll form, and cut into sheets of a regular length. The sheets are stacked in a plurality. A protective cover is loaded with the sheets to form a covered sheet stack. The protective cover is used for preventing the X-ray film from being bent or folded, and from being scratched. The covered sheet stacked is wrapped in a light-shielding packaging bag, and is enclosed tightly. The packaging bag is inserted in an outer box, and is shipped.

A producing system for the sheet package of the X-ray film include a slitting device, a cutting/stacking device, a bag packaging machine, a box forming device, a box packaging machine and a cardboard caser. The slitting device slits web of photosensitive material with a great width into continuous sheets with a width of a sheet size. The cutting/stacking device cuts the continuous sheets into the sheets, and stacks the sheets in the predetermined number. The bag packaging machine closes a bag by sealing in a pillow shape or sealing three edges. The box forming device produces the outer box for containing the X-ray film. The box packaging machine inserts the X-ray film into the outer box. The cardboard caser inserts the outer box with the X-ray film into a cardboard box.

The bag packaging machine, which is disposed downstream in the producing system for the sheet package, operates for one time while the cutting/stacking device creates a predetermined number of the sheets by cutting. It is necessary to change over the bag packaging machine rapidly specifically for production at the sheet size being different, or in a multi-type manner. Therefore, recently used types of the bag packaging machine have had a gradual tendency of enlargement in the size, raise in complexity, and raise in performance. There is a suggestion in JP-A 5-051021 to install a plurality of the cutting/stacking device in an upstream station. Paths of the sheets from the cutting/stacking device are joined up as a single path at the bag packaging machine.

The number of the sheet size of the X-ray film is small. It is general that the producing system is structured in a specialized manner for a predetermined size of the sheet size. In the producing system for the X-ray film, the protective cover is pre-bent at a target end portion to be folded. The sheets are stacked on the protective cover after the pre-bending. Then the protective cover is folded before forming the sheet package.

In the producing system including the cutting/stacking device in the plurality, the ability of processing of the bag packaging machine is considered as minimum ability. If a difference occurs between the ability and that required in view of profits, it requires a remarkably large space for installation, and also expenses for investment. Furthermore, the facilities with the producing system are hard to maintain in a stable state. This is the case typically because the personnel having high skill in monitoring and handling the producing system cannot be easily employed.

For multi-type production, frequent changes are inevitable in the bag packaging machine about the sheet size and the type. It is likely that the sheet size or the type is different between the bag packaging machine and the cutting/stacking device operating at the same time. The X-ray film different in the sheet size or the type at the time of processing in the bag packaging machine is stored in a temporary manner. This results in precise administration of addresses of the X-ray film in the reservoir, precision in planning the production with judgement in priority of plural processes, precision in the administration of the production in relation to instructions, monitoring of achievements and the like, and complexity in systemizing the administration of information. To reserve the X-ray film requires sufficient spaces, which is likely to be inconsistent to rapidity in shipment of the X-ray film.

The producing system specialized for the X-ray film has low compatibility with the producing system for products other than the X-ray film. If a new product of the X-ray film is developed, the producing system cannot be applied in the initially specialized structure. A problem arises in a short period of using the same facilities of the producing system.

SUMMARY OF THE INVENTION

In view of the foregoing problems, an object of the present invention is to provide a sheet package producing system for producing a sheet package having a stack of sheets at a low cost and in a manner with compatibility to various sheet types.

In order to achieve the above and other objects and advantages of this invention, a sheet package producing system for producing a sheet package having a predetermined number of sheets is provided. A cutting/stacking device forms the sheets by cutting continuous sheet at a regular length, and for stacking the sheets in the predetermined number. A covered sheet stack producing device inserts the stacked sheets into a protective cover, to obtain a covered sheet stack. A packaging device packages the covered sheet stack to obtain the sheet package. The cutting/stacking device, the covered sheet stack producing device and the packaging device are connected in series with one another.

The cutting/stacking device, the covered sheet stack producing device and the packaging device are balanced in line capacity balance relative to one another.

The protective cover includes transversely extending plural bending lines for defining first, second and third portions, the first portion being positioned on an end face of the stacked sheets, the second and third portions being positioned on upper and lower faces of the stacked sheets. The covered sheet stack producing device includes a first handling module for placing either one of the second portion and the stacked sheets on an upper surface of a remaining one thereof. A folding module folds the protective cover along the plural bending lines, and squeezes the stacked sheets between the second and third portions, to obtain the covered sheet stack.

The cutting/stacking device includes a supply module for feeding the continuous sheet. A cutter module cuts the continuous sheet to obtain the sheets. A stacker module stacks the sheets in the predetermined number.

The first handling module places the protective cover on the stacked sheets. Furthermore, a second handling module is robotic, turns over a sheet orientation of the stacked sheets to locate the protective cover under the stacked sheets, and then sets the protective cover and the stacked sheets to the folding module. The folding module folds the protective cover by moving upward the third portion.

The cutting/stacking device further includes a synchronizing unit for synchronizing the supply module, the cutter module and the stacker module with one another.

The supply module, the cutter module and the stacker module include respectively drive power sources. The synchronizing unit electrically synchronizes the drive power sources.

In another preferred embodiment, the supply module, the cutter module and the stacker module include respectively first, second and third mechanisms being rotatable or movable. The cutting/stacking device includes a drive power source for actuating one of the first, second and third mechanisms. The synchronizing unit includes a transmission coupling for mechanically transmitting force of driving of the one mechanism to remaining ones of the first, second and third mechanisms.

The one mechanism is the second mechanism.

The covered sheet stack producing device further includes a pre-bending module, actuated earlier than the folding module, for bending the protective cover temporarily by forcibly depressing the third portion. The first handling module sets the protective cover on the pre-bending module, and then places the protective cover on the stacked sheets.

The second handling module includes a sheet chuck for capturing the stacked sheets. A moving robot arm moves the sheet chuck. A rotating mechanism is secured to the sheet chuck or the moving robot arm, for rotating the sheet chuck to turn over the sheet orientation.

The first handling module includes a cover suction pad for sucking the protective cover. A cover moving robot arm moves the cover suction pad.

The packaging device includes a bag packaging machine for packaging the covered sheet stack in a packaging bag. A box packaging machine packages the covered sheet stack in an outer box after packaging in the packaging bag, to obtain the sheet package.

The bag packaging machine includes a stack feeding module for feeding the covered sheet stack. A bag-forming/inserting module wraps the covered sheet stack with bag material. A package finishing module folds a margin flap of the bag material wrapping the covered sheet stack, to enclose the covered sheet stack in the packaging bag.

The box packaging machine includes a box forming module, being robotic, for forming the outer box by bending a plate material or sheet material. A box inserting module inserts the covered sheet stack into the outer box after packaging in the packaging bag.

The cutting/stacking device further includes a decurler module for eliminating or reducing a curling tendency of the continuous sheet.

Each of the cutting/stacking device, the covered sheet stack producing device and the packaging device includes plural modules. A pallet is disposed in each of the plural modules, having a size predetermined in consideration of a maximum size of the sheets, for supporting the continuous sheet, the sheets, the protective cover, the covered sheet stack or the sheet package.

In an alternative structure, the protective cover includes a transversely extending bending line for defining first and second portions, the bending line being adapted to folding, to oppose the first and second portions to one another. The covered sheet stack producing device includes a first handling module, being robotic, for placing either one of the first portion and the stacked sheets on an upper surface of a remaining one thereof. A folding module folds the protective cover along the bending line, and squeezes the stacked sheets between the first and second portions, to obtain the covered sheet stack.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
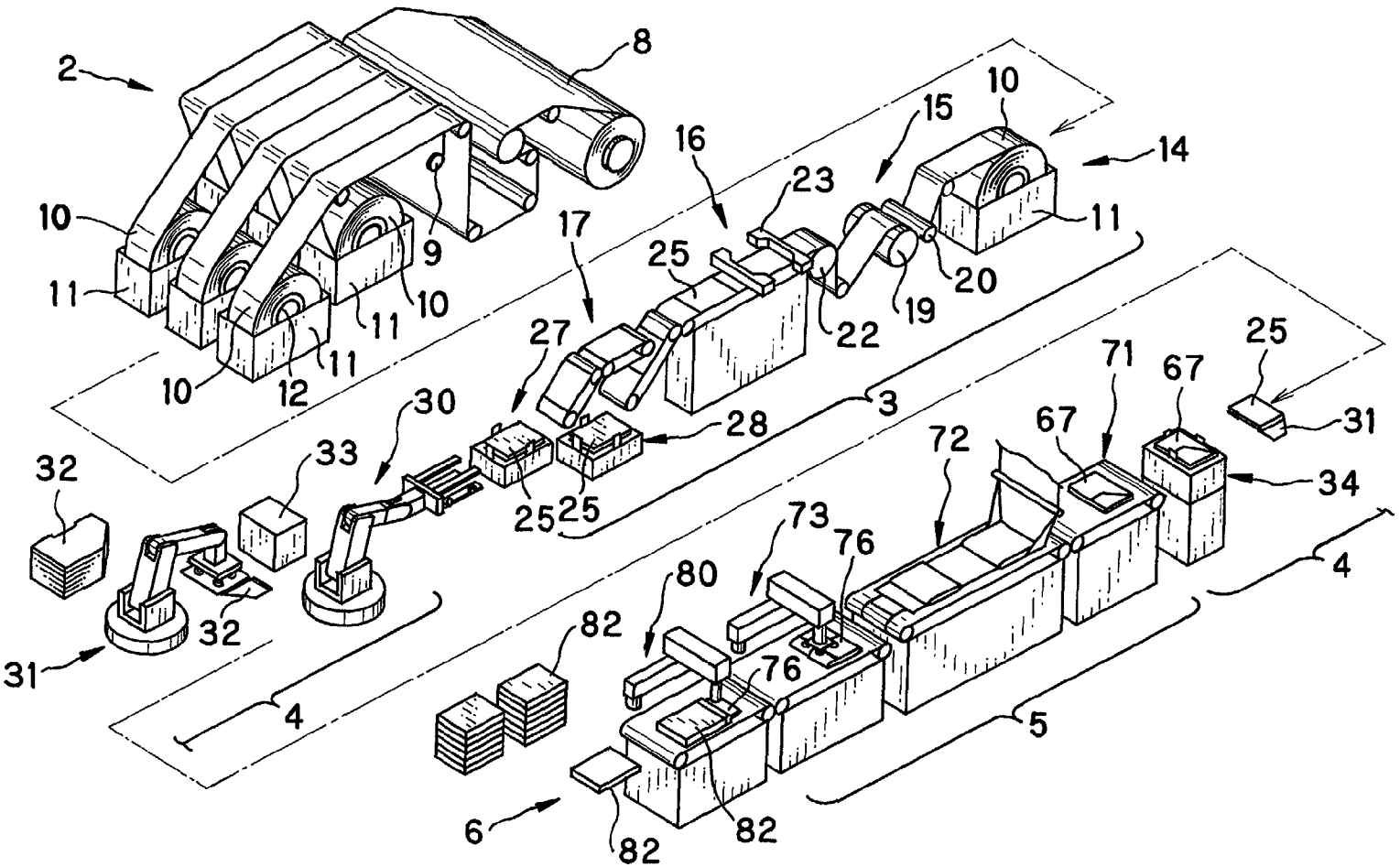
FIG. 1 is a perspective illustrating a sheet package producing system.

In FIG. 1, an X-ray film producing system is schematically illustrated. The system includes a slitting device 2, a cutting/stacking device 3, a covered sheet stack producing device 4, a bag packaging machine 5 and a box packaging machine 6, the bag packaging machine 5 and the box packaging machine 6 constituting a packaging device. Those devices are balanced in relation to the line capacity balance, and are connected in series. Due to this, substantially no reservation of the material occurs between the devices. Also, the slitting device 2, the cutting/stacking device 3, the covered sheet stack producing device 4 and the bag packaging machine 5 are disposed in a dark room or dark compartment and shielded from light.

Web 8 with a great width as uncut material of X-ray film is fed in the slitting device 2. Slitting blades 9 of the slitting device 2 slit the web 8 at a width of each X-ray film as product. A continuous sheet 10 is obtained. A spool 12 is set in a continuous sheet container 11, and winds the continuous sheet 10 in a roll form. After this, the continuous sheet container 11 is removed from the slitting device 2 and set into the cutting/stacking device 3.

The cutting/stacking device 3 is constituted by various modules which are a supply module 14, a decurler module or uncurler module 15, a cutter module 16 and a stacker module 17. The supply module 14 is provided with the continuous sheet container 11 containing the continuous sheet 10. There is a regular tension control mechanism which applies predetermined tension to the continuous sheet 10. The continuous sheet 10 is drawn from the continuous sheet container 11 in a state with the tension. The supply module 14 includes a splicing unit for connecting a rear end of the continuous sheet 10 with a front end of a new continuous sheet when the remainder of the continuous sheet 10 decreases and comes near to the minimum.

A heating roller 19 and a cooler are included in the decurler module 15. The heating roller 19 is heated at a temperature lower than that which would influence the quality of the X-ray film. The heating roller 19 contacts the continuous sheet 10 kept curved, to uncurl the continuous sheet 10. After the heating roller 19 operates, the cooler cools the continuous sheet 10 and keeps the uncurled state of the continuous sheet 10. A dancer roller 20 is disposed upstream from the heating roller 19, and absorbs small changes in the tension of the continuous sheet 10.

The cutter module 16 includes a suction drum 22 and a rotary oscillation cutter 23. The suction drum 22 operates for feeding the continuous sheet 10 at a regular rate. The rotary oscillation cutter 23 is actuated in synchronism with the suction drum 22 electrically and mechanically. The continuous sheet 10 is cut by the rotary oscillation cutter 23 at a regular length, to be sheets 25 or X-ray films. See FIG. 2. Furthermore, corners of the sheets 25 are rounded by cutting.

Figure 3:
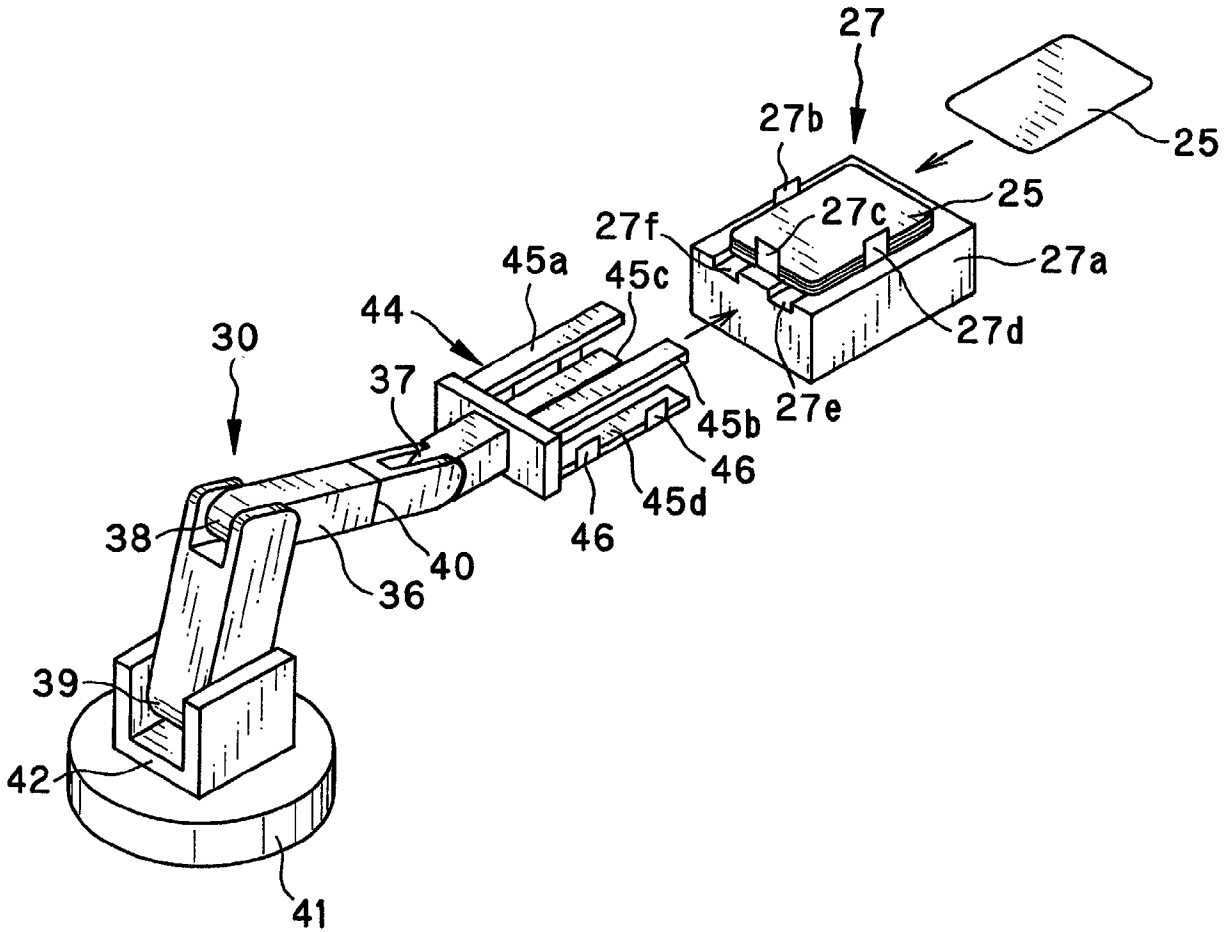
FIG. 3 is a perspective illustrating a stacker and a sheet handling module about to capture sheets at the stacker.

The stacker module 17 includes stackers 27 and 28 and a sorting gate. The stackers 27 and 28 receive the sheets 25 from the cutter module 16, and reserve the sheets 25 in a stacked state. The sorting gate guides the sheets 25 to an appropriate one of the stackers 27 and 28. In FIG. 3, the stacker 27 includes a quadrilateral pallet 27*a* and guide ridges 27*b*, 27*c* and 27*d*. The quadrilateral pallet 27*a* has an upper surface where the sheets 25 are stacked. The guide ridges 27*b*–27*d* regulate three edges of the sheets 25 on the quadrilateral pallet 27*a*. The stacker 28 is structurally the same as the stacker 27. Also, an ejection gate is disposed in the stacker module 17 for ejecting sheets of irregular sizes from the manufacturing line.

The supply module 14, the decurler module 15, the cutter module 16 and the stacker module 17 has a pallet or base plate having a common size determined in consideration of the expected maximum size of an X-ray film. Each of the modules can be added, removed or exchanged easily by retention with bolts.

Figure 1A:
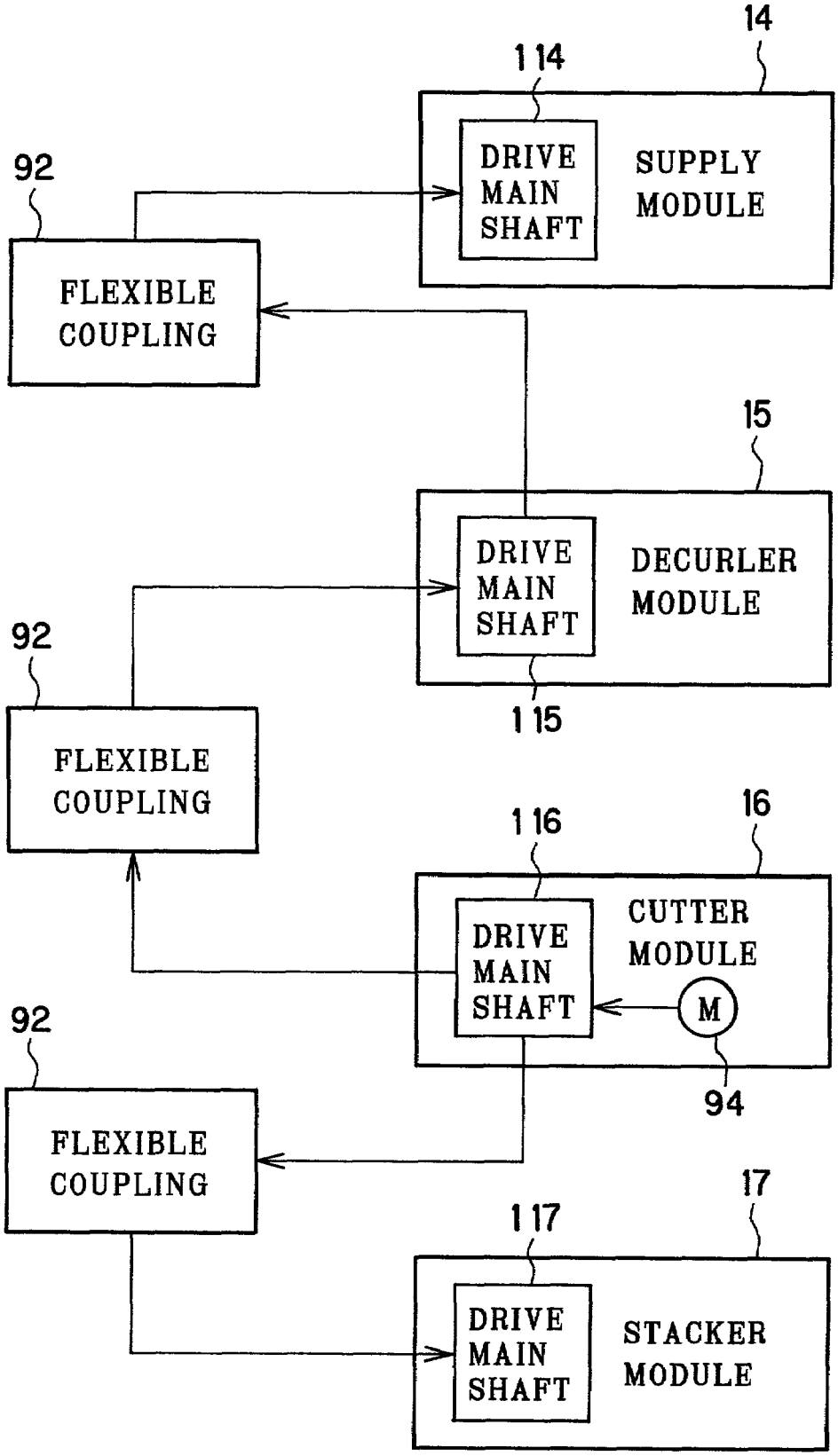
FIG. 1A is a diagram schematically illustrating modules in a cutting/stacking device and flexible couplings for transmission.

In FIG. 1A, a motor 94 as drive power source is disposed in the cutter module 16 for driving the cutting/stacking device 3. A drive main shaft 116 is included in the cutter module 16, and connected with the motor 94. Drive main shafts 114, 115 and 117 are disposed in respectively the supply module 14, the decurler module 15 and the stacker module 17, and have such an arrangement that a size of a space occupied by those is equal. Flexible couplings or transmission couplings 92 as synchronizing unit of a single type are provided, and interconnect respectively two adjacent shafts included in the drive main shafts 114–117. Thus, the force of driving of the motor 94 is transmitted to the supply module 14, the decurler module 15 and the stacker module 17, which can be synchronized.

Figure 1B:
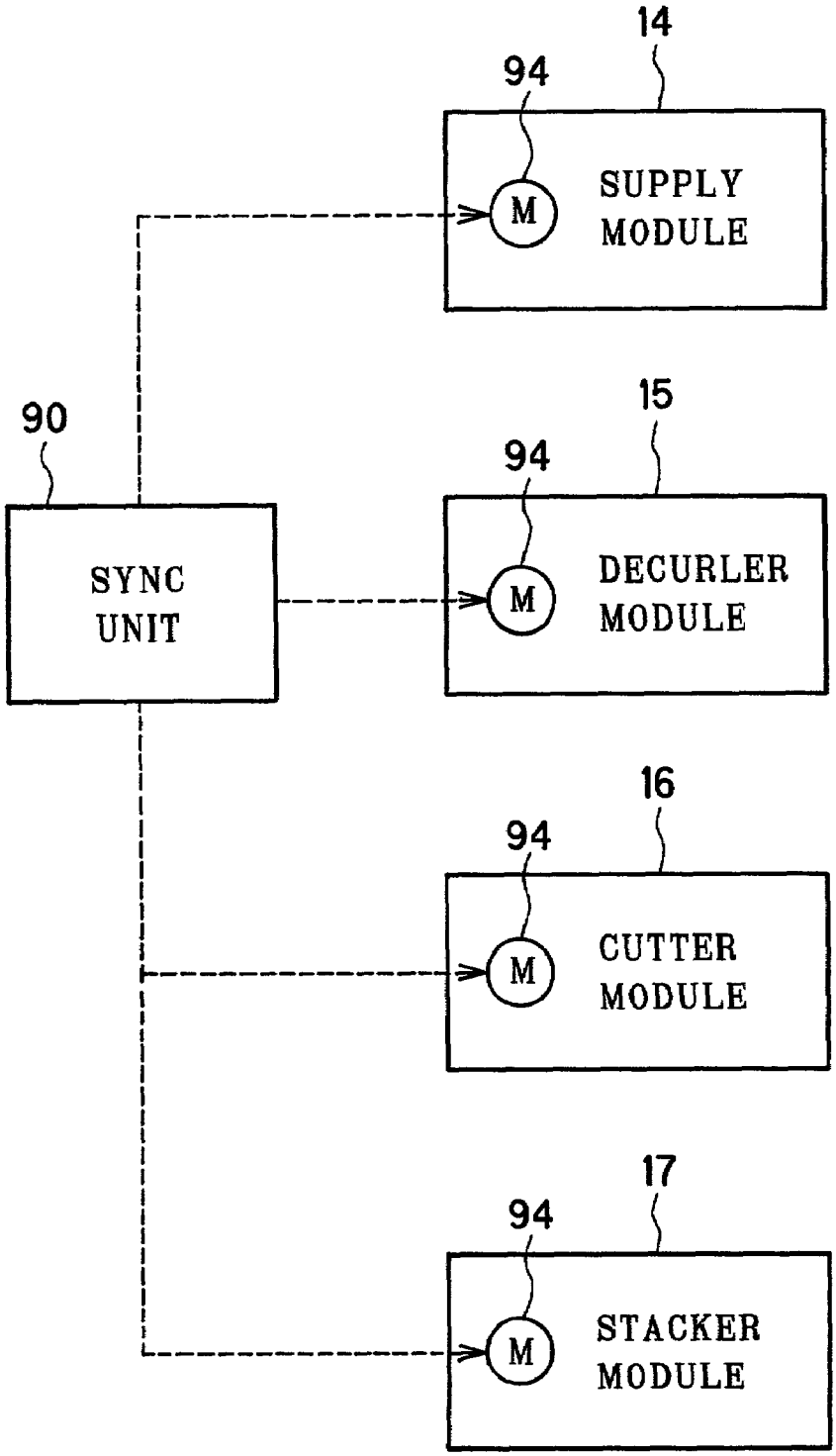
FIG. 1B is a diagram schematically illustrating another preferred embodiment in which the modules are electrically synchronized.

Control units are associated with respectively the supply, decurler, cutter and stacker modules 14–17 in a separate manner. A main control unit for administrating the whole of the producing system is provided. The separate control units are connected to the main control unit, and receive signals for a start and stop of operation, and command of speed. For other items of the control, the separate control units operate per each of workpieces. Note that the supply, decurler, cutter and stacker modules 14–17 may be synchronized by other constructions than the flexible couplings 92 and the drive main shafts 114–117. In FIG. 1B, the motor 94 is incorporated in each of the supply, decurler, cutter and stacker modules 14–17. A synchronizing unit 90 operates for control between invertors, and synchronizes the plurality of the motors 94 electrically.

The covered sheet stack producing device 4 is constituted by a sheet handling module 30, a cover handling module 31, a pre-bending module 33 and a folding module 34. The sheet handling module 30 captures a stack of the sheets 25 from the stacker module 17 in the cutting/stacking device 3. A protective cover 32 is handled by the cover handling module 31. The pre-bending module 33 pre-bends the protective cover 32 before folding in the final step. The folding module 34 folds the protective cover 32 loaded with the sheets 25.

In FIG. 3, the sheet handling module 30 is constituted by a general-purpose robot or six-axis vertically articulated type of robot with a sheet moving robot arm 36 of a bendable structure. The sheet moving robot arm 36 includes a first joint 37, a second joint 38, a third joint 39 and rotational pivots 40 and 42. The rotational pivot 40 is disposed between the first joint 37 and the second joint 38. A base plate 41 is provided, on which the rotational pivot 42 keeps the sheet moving robot arm 36 rotatable. A sheet chuck 44 is fixed on a distal end of the sheet moving robot arm 36, and squeezes and handles a stack of the sheets 25. The sheet chuck 44 includes chuck plates 45*a*, 45*b*, 45*c* and 45*d* and protection ridges 46. The chuck plates 45*a*, 45*b*, 45*c* and 45*d* contact front and rear surfaces of the sheets 25. The protection ridges 46 project from the chuck plates 45*c* and 45*d*, and regulate lateral edges of the sheets 25. The chuck plates 45*c* and 45*d* are stationary. The chuck plates 45*a* and 45*b* are movable up and down with reference to the chuck plates 45*c* and 45*d*.

Grooves 27*e* and 27*f* are formed in the quadrilateral pallet 27*a* of the stacker 27. The sheet handling module 30 inserts the chuck plates 45*c* and 45*d* into the grooves 27*e* and 27*f*. Then the chuck plates 45*a* and 45*b* are moved down toward the chuck plates 45*c* and 45*d*, to squeeze the sheets 25. The joints of the sheet moving robot arm 36 are actuated, to pick up the sheets 25 from the stacker 27.

Figure 4:
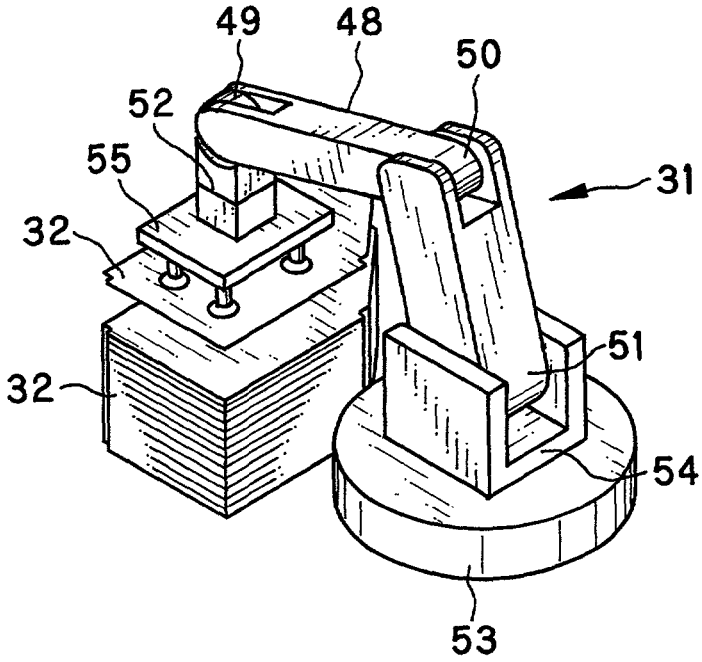
FIG. 4 is a perspective illustrating a cover handling module supplying the protective cover.

In FIG. 4, the cover handling module 31 is constituted by a general-purpose robot with a cover moving robot arm 48 of a bendable structure. The cover moving robot arm 48 includes a first joint 49, a second joint 50, a third joint 51 and rotational pivots 52 and 54. The rotational pivot 52 is disposed between the first joint 49 and the second joint 50. A base plate 53 is provided, on which the rotational pivot 54 keeps the cover moving robot arm 48 rotatable. Cover suction pads 55 are fixed on a distal end of the cover moving robot arm 48, and suck and hold an uppermost one of the protective cover 32 by suction of air. Note that the cover handling module 31 may include the same general-purpose robot as the sheet handling module 30. Again, the cover suction pads 55 are used with the robot of this type.

Figure 2:
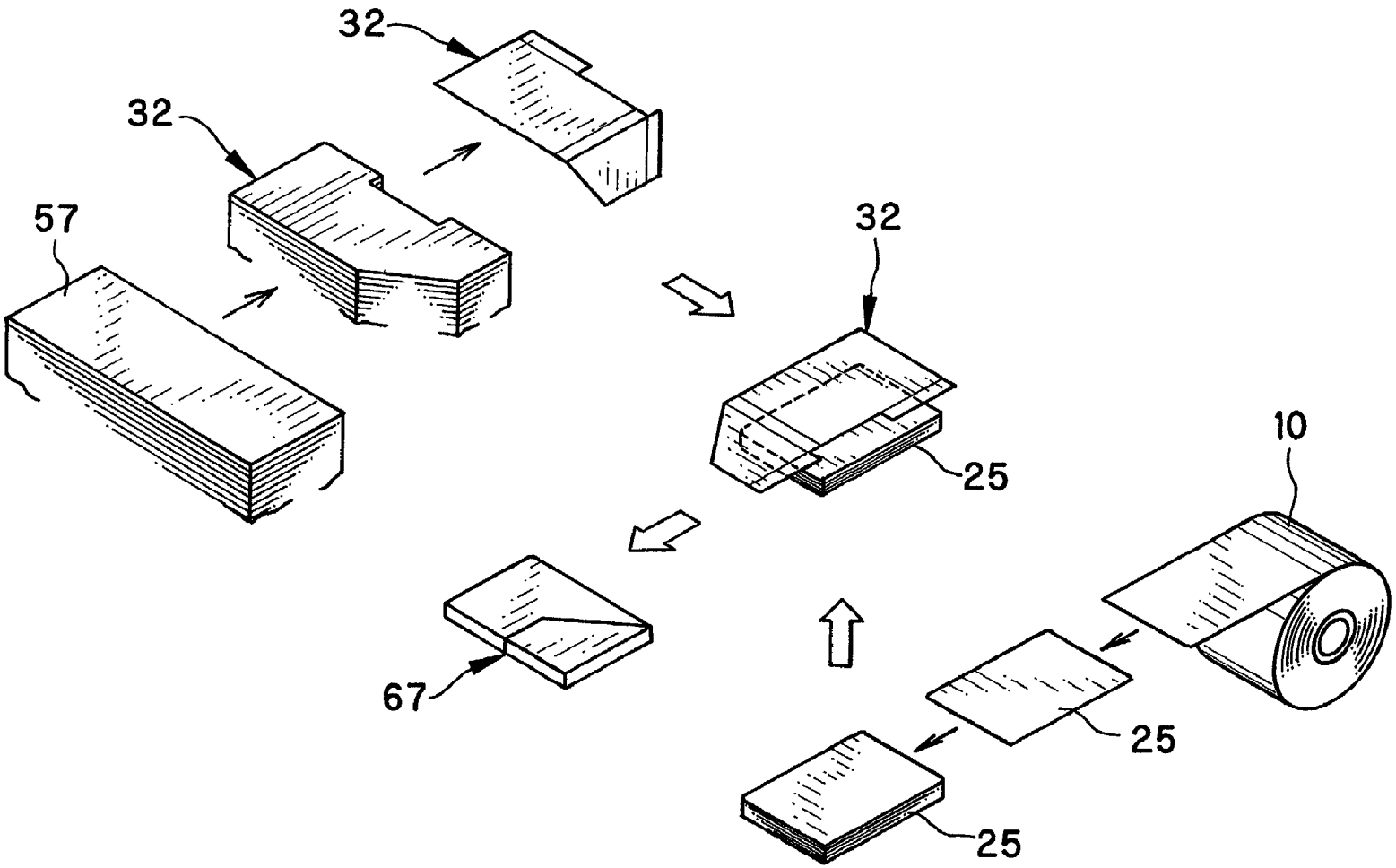
FIG. 2 is a perspective illustrating processes of producing a sheet package from sheets and a protective cover.

The protective cover 32 consists of a sufficiently thick plate with rigidity, such as a cardboard. In FIG. 2, quadrilateral boards 57 are prepared as raw material, and are cut into the protective cover 32 nearly in a trapezoidal shape.

The protective cover 32 is bent at four portions to protect the front and rear surfaces of the sheets 25 and one of their lateral edge.

Figure 5:
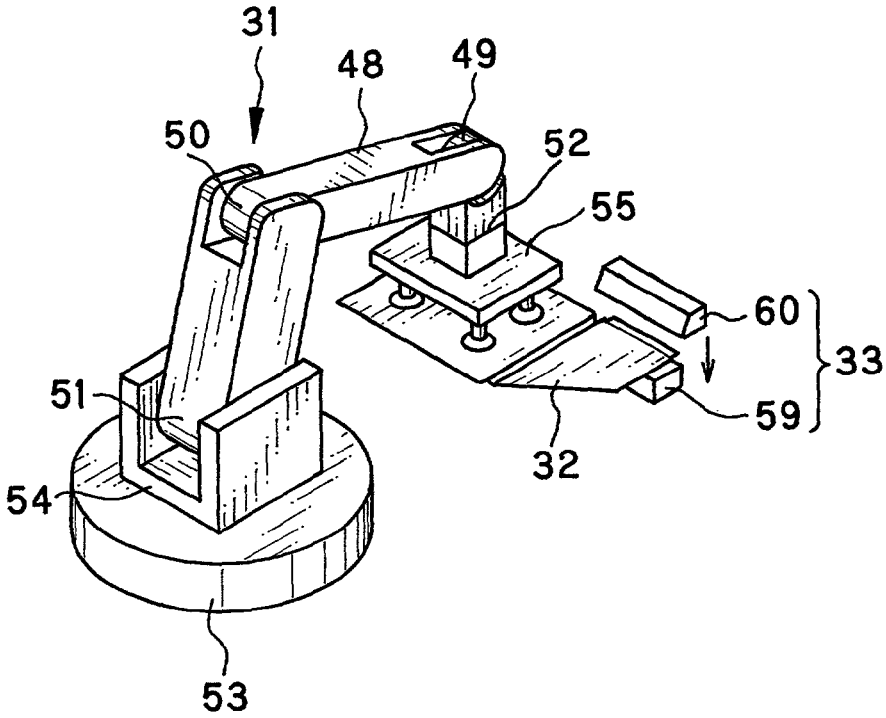
FIG. 5 is a perspective illustrating a pre-bending module operating in cooperation with the cover handling module.

In FIG. 5, the pre-bending module 33 includes a base 59, a bender plate 60, and a moving mechanism. The base 59 contacts a lower surface of the protective cover 32. The bender plate 60 moves down to lap an end face of the base 59. The moving mechanism moves the bender plate 60. The cover handling module 31 moves a target end portion of the protective cover 32 to the base 59 of the pre-bending module 33, and sets the same positioned. After this, the bender plate 60 moves down toward the base 59, to bend the target end portion in a preliminary or pre-bending manner. The cover handling module 31 sets the target end portion of the protective cover 32 on the pre-bending module 33 one cover after another. Finally, all of the plurality of the protective covers 32 are bent preliminarily.

Figure 6:
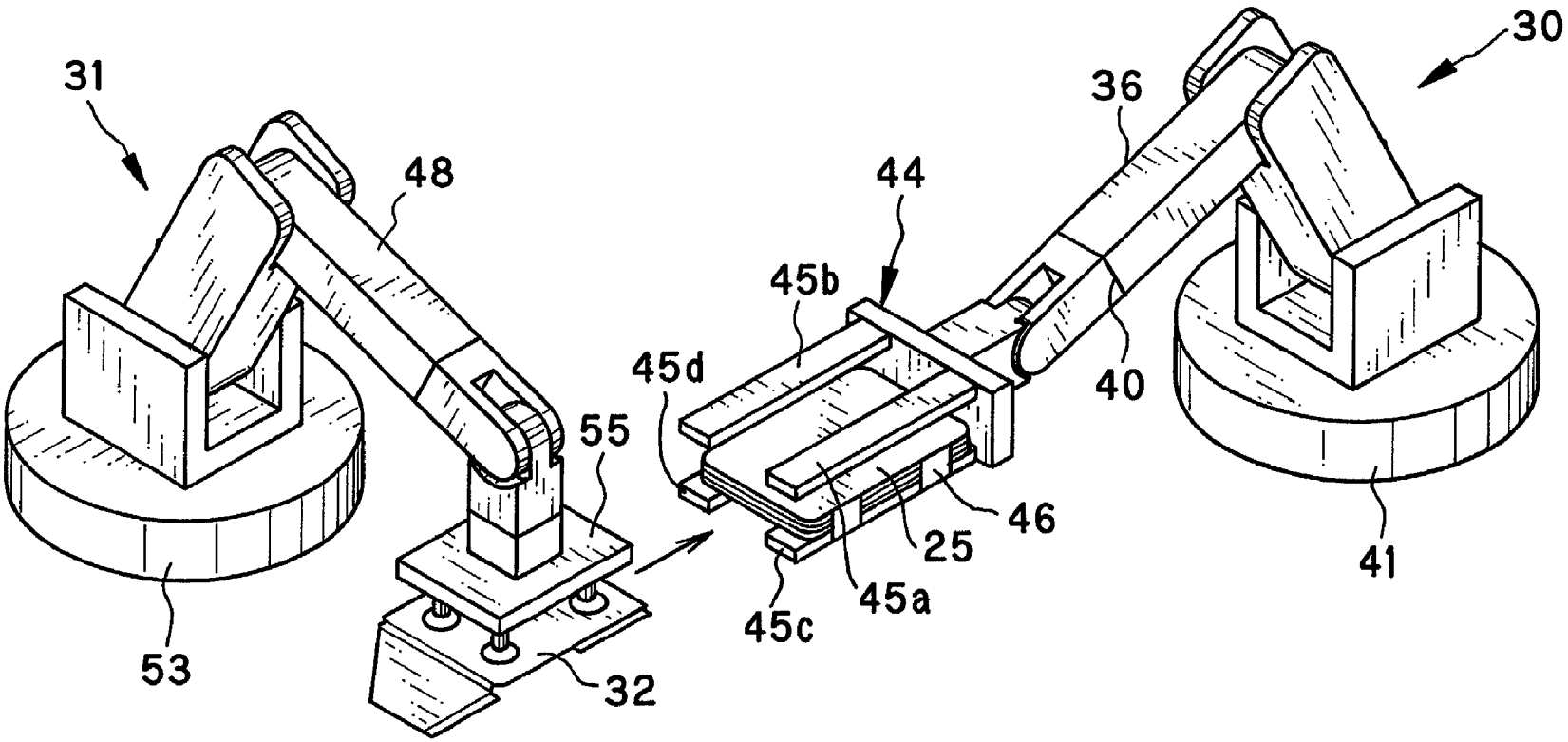
FIG. 6 is a perspective illustrating the cover handling module placing the protective cover to the sheets handled by the sheet handling module.
Figure 7:
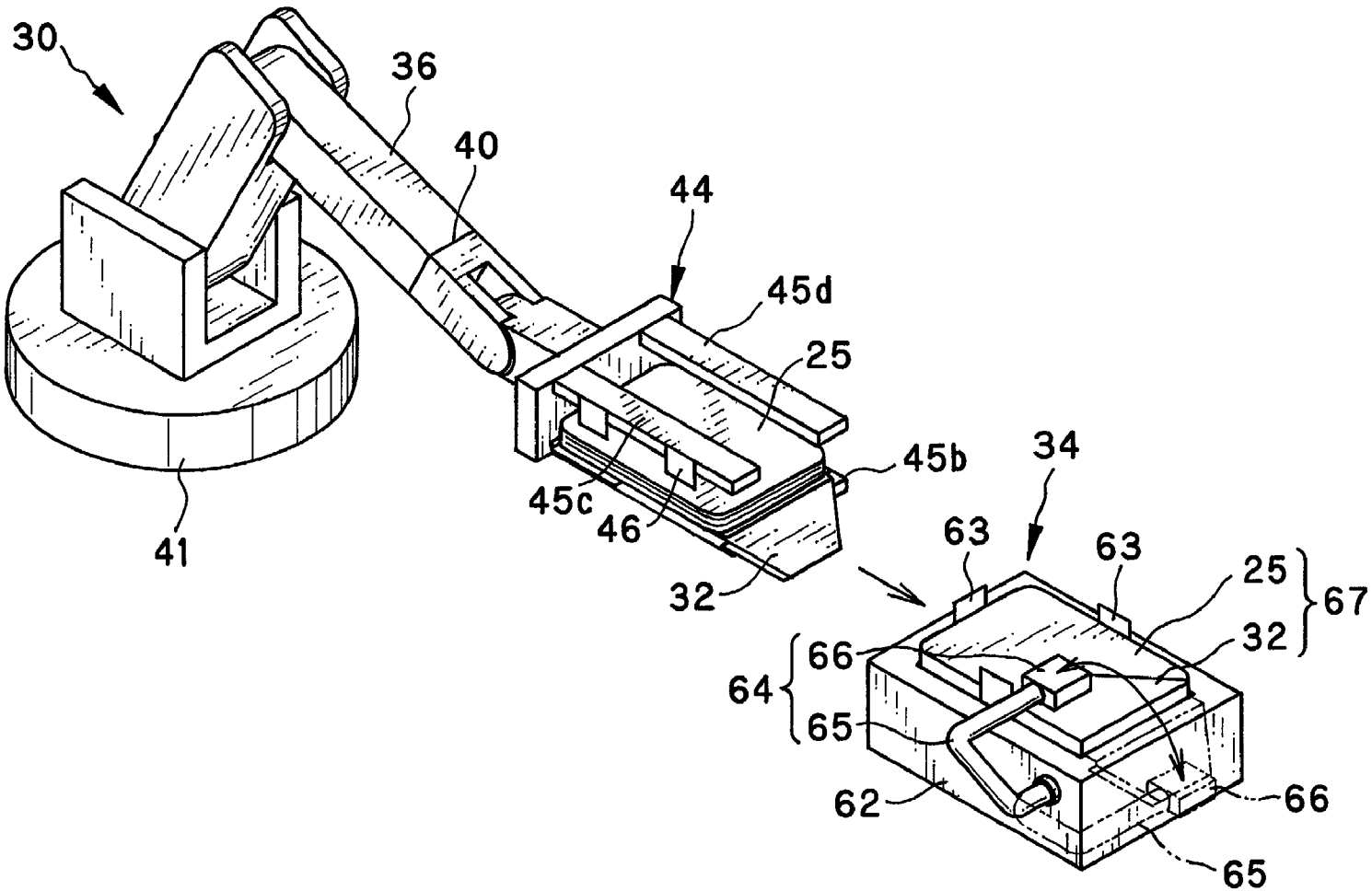
FIG. 7 is a perspective illustrating the sheet handling module and a folding module folding the protective cover.

In FIG. 6, the protective cover 32 after being pre-bent is placed by the cover handling module 31 on to the sheets 25 grasped by the sheet chuck 44 of the sheet handling module 30. The sheet chuck 44 is actuated again to squeeze the sheets 25 and the protective cover 32 together. In FIG. 7, the sheet handling module 30 causes the sheet chuck 44 to make half a rotation by means of the rotational pivot 40, to turn over the sheets 25 and the protective cover 32. The sheets 25 and the protective cover 32 are supplied to the folding module 34.

The folding module 34 includes a quadrilateral pallet 62, guide ridges 63 and a folding arm 64. The quadrilateral pallet 62 supports the sheets 25 and the protective cover 32 placed thereon. The guide ridges 63 regulate three edges of the sheets 25 and the protective cover 32 on the quadrilateral pallet 62. The folding arm 64 folds the protective cover 32 to squeeze the sheets 25. The folding arm 64 includes an arm portion 65 and a folding pad 66. The arm portion 65 has substantially a channel shape, and has one end rod supported on a lateral wall of the quadrilateral pallet 62 in a rotatable manner. The folding pad 66 is a suction pad secured to a remaining end rod of the arm portion 65. The arm portion 65 is rotatable between a first position of the phantom line and a second position of the solid line. When the arm portion 65 rotates from the first position to the second position, the folding pad 66 pushes the protective cover 32 and folds the same to wrap the sheets 25.

Figure 8:
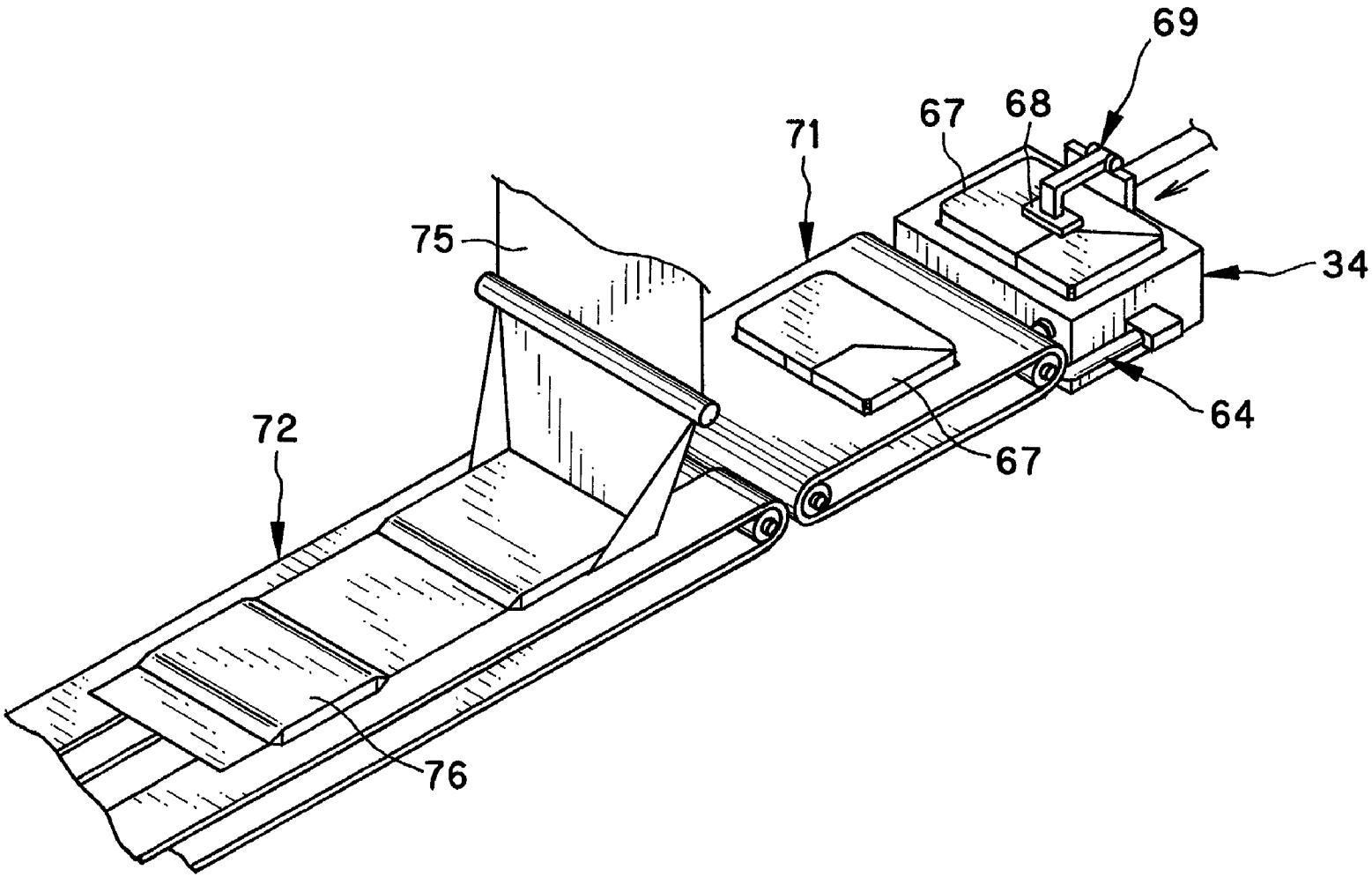
FIG. 8 is a perspective illustrating the folding module, a stack feeding module and a bag-forming/inserting module.

A covered sheet stack 67 is created by inserting the sheets 25 in the protective cover 32. In FIG. 8, a retention mechanism 69 includes a retention pad 68 for keeping the protective cover 32 closed by contacting an upper surface of the covered sheet stack 67. In feeding the covered sheet stack 67, plates having the guide ridges 63 are retracted to the inside of the quadrilateral pallet 62.

The pre-bending module 33 and the folding module 34 have the pallet or base plate having a common size determined in consideration of the expected maximum size of an X-ray film. Each of the modules can be added, removed or exchanged easily by retention with bolts. In the general-purpose robots in the sheet handling module 30 and the cover handling module 31, the sheet chuck 44 and the cover suction pads 55 can be exchanged for each of types of the products. Thus, various types and sizes of the products can be produced.

Control units are separately associated with respectively the modules included in the covered sheet stack producing device 4. However, the general-purpose robots in the sheet handling module 30 and the cover handling module 31 are controlled in a harmonized manner. The main control unit for the producing system is provided. The separate control units of the modules in the covered sheet stack producing device 4 are connected to the main control unit, and receive signals for a start and stop of operation, and command of speed.

The bag packaging machine 5 includes a stack feeding module 71, a bag-forming/inserting module 72 and a package finishing module 73. The stack feeding module 71 feeds the covered sheet stack 67 from the covered sheet stack producing device 4 toward a downstream side. The bag-forming/inserting module 72 packages the covered sheet stack 67 according to the pillow packaging. The stack feeding module 71 consists of a conveyor belt, and sends the covered sheet stack 67 to the bag-forming/inserting module 72. Note that the stack feeding module 71, instead of the conveyor belt, may include a chain having plural feeding claws.

Figure 9:
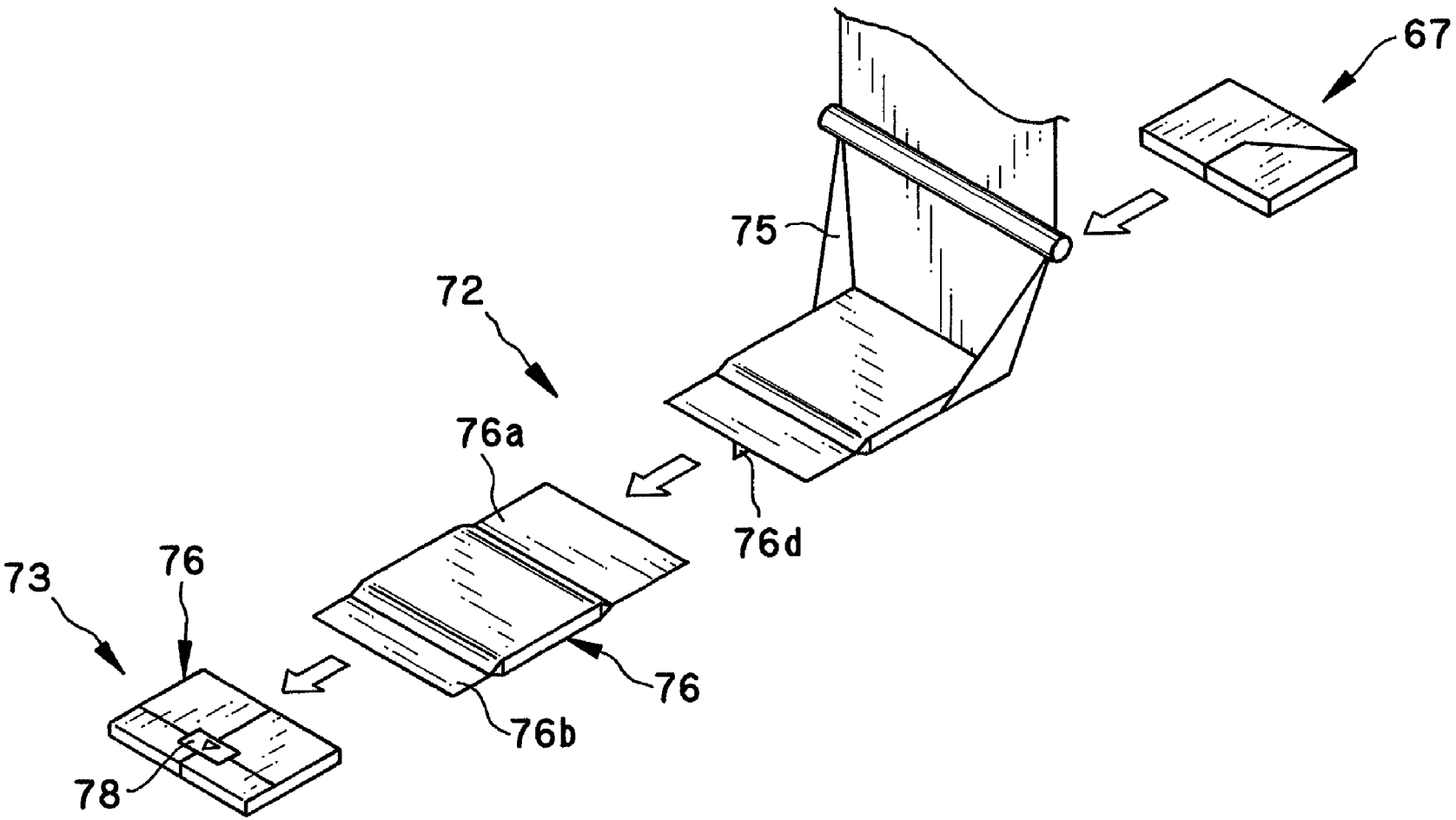
FIG. 9 is a perspective illustrating a process of packaging the sheet package to obtain a packaging bag.

In FIGS. 8 and 9, light-shielding bag material 75 consists of film material, which includes a support of a plastic film and a layer of an aluminum foil overlaid thereon. The bag-forming/inserting module 72 forms the light-shielding bag material 75 into a tubular shape, and also wraps the covered sheet stack 67 in the light-shielding bag material 75. A juncture sealer of the bag-forming/inserting module 72 welds juncture facets **76*d* of the light-shielding bag material 75 to one another by heat and pressure. A cross sealer welds and closes front and rear flaps of a tubular portion of the light-shielding bag material 75, at the same time as those flaps are cut. A packaging bag 76 is provided, from which air is removed by an air removing pipe. Finally, the covered sheet stack 67 is enclosed in the packaging bag 76** in a tightly packaged manner.

The package finishing module 73 includes a flap folding mechanism of a general-purpose type. A corner of a rear flap **76*a* of the packaging bag 76 is grasped by a robot hand which is disposed in the package finishing module 73 and secured to a robot being movable straight. The robot hand applies tension to the rear flap 76*a* in two directions, and folds it without creating wrinkles. A front flap 76*b* of the packaging bag 76 is also folded. The rear and front flaps 76*a* and 76*b* are retained by a retention mechanism contacting an upper surface of the packaging bag 76. Finally, a sticker 78 is attached to the rear and front flaps 76*a* and 76*b* to secure those to the packaging bag 76**.

The stack feeding, bag-forming/inserting, and package finishing modules 71–73 have a pallet or base plate having a common size determined in consideration of the expected maximum size of an X-ray film. Each of the modules can be added, removed or exchanged easily by retention with bolts. Control units are associated with respectively the stack feeding, bag-forming/inserting, and package finishing modules 71–73 in the bag packaging machine 5 in a separate manner. The separate control units are connected to the main control unit, and receive signals for a start and stop of operation, and command of speed.

Figure 10:
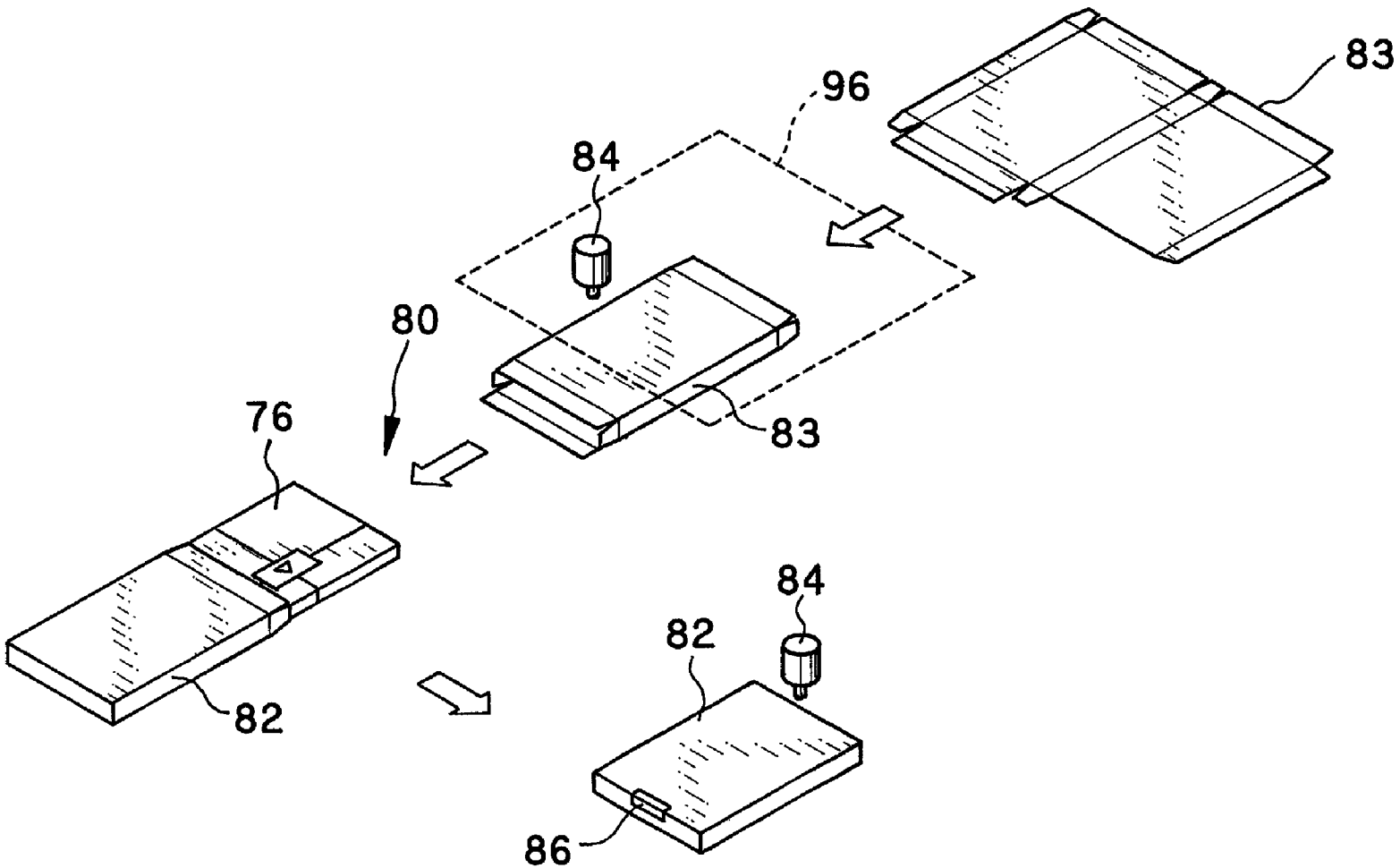
FIG. 10 is a perspective illustrating a process of forming a blank sheet into an outer box and inserting the packaging bag.

The box packaging machine 6 includes a box forming module 96, a box inserting module 80 and a cardboard caser. The box forming module 96 consists of a general-purpose robot similar to that of the cover handling module 31 described above. See FIG. 10. A folding station is located in the box forming module 96. A blank sheet 83 is handled by the general-purpose robot. The folding station folds a target end portion of the blank sheet 83, so that an outer box 82 with a decorative pattern is created. Also, a hot-melt gun 84 is disposed in the folding station, ejects hot-melt adhesive agent at a suitable amount, and attaches portions of a juncture of the outer box 82.

The box inserting module 80 inserts a guide plate into the outer box 82, to place the packaging bag 76 having the covered sheet stack 67 into the outer box 82. Then a lid of the outer box 82 is closed. A sticker 86 is attached to the outer box 82 by the box inserting module 80. In the box inserting module 80, information such as a lot number is printed to the outer box 82. An image processor inspects the outer box 82 for appearance to check the attached state of the sticker 86, the printed state and the like.

The cardboard caser consists of a multi-joint robot of a general-purpose type to handle the outer box 82, and inserts five outer boxes 82 to a single outer packaging cardboard box.

The box forming module 96, the box inserting module 80 and the cardboard caser have a pallet or base plate having a common size determined in consideration of the expected maximum size of an X-ray film. Each of the modules can be added, removed or exchanged easily by retention with bolts. Control units are associated with respectively the box forming module 96, the box inserting module 80 and the cardboard caser in a separate manner. The separate control units are connected to the main control unit, and receive signals for a start and stop of operation, and command of speed.

The operation of the above embodiment is described now. In FIG. 1, the web 8 of X-ray film with a large width is set in the slitting device 2, and slitted by the slitting blades 9 at the width of the product. The continuous sheet 10 obtained by the slitting is wound about the spool 12 set in the continuous sheet container 11.

The continuous sheet container 11 containing the continuous sheet 10 is removed from the slitting device 2 and set into the cutting/stacking device 3. Then the continuous sheet 10 is drawn from the continuous sheet container 11 in a state with tension applied by the regular tension control mechanism. The continuous sheet 10 is unwound, and uncurled by operation of the heating roller 19 of the decurler module 15 and the cooler.

The continuous sheet 10 after being uncurled is fed by the suction drum 22 in the cutter module 16 at a regular rate, and cut by the rotary oscillation cutter 23 synchronized with the suction drum 22. Thus, the sheets 25 in FIG. 2 are obtained. The sheets 25 are fed by the conveyor of the stacker module 17, and stacked in the stackers 27 and 28.

In FIG. 3, the sheet handling module 30 inserts the chuck plates 45*c* and 45*d* into the grooves 27*e* and 27*f* formed in the quadrilateral pallet 27*a* of the stacker 27. Then the chuck plates 45*a* and 45*b* are moved down, to squeeze the sheets 25 by cooperation with the chuck plates 45*c* and 45*d*. The joints of the sheet moving robot arm 36 are actuated, to pick up the sheets 25 away from the stacker 27.

At the same time as the sheets 25 are produced and stacked, the protective cover 32 is pre-bent. In FIG. 4, the cover suction pads 55 in the cover handling module 31 suck and retain the protective cover 32 cut and stacked in a shape of a trapezoid.

In FIG. 5, the protective cover 32 is fed to the pre-bending module 33, to insert the target end portion of the protective cover 32 between the base 59 and the bender plate 60. A moving mechanism (not shown) moves down the bender plate 60, to pre-bend the protective cover 32 by squeezing with the base 59. The cover handling module 31 sets the target end portion of the protective cover 32 to the pre-bending module 33 one piece after another, until all the prepared pieces of the protective cover 32 are pre-bent finally.

In FIG. 6, the protective cover 32 being pre-bent is placed by the cover handling module 31 on to an upper surface of the sheets 25 grasped by the sheet chuck 44 of the sheet handling module 30. In the sheet handling module 30 provided with the protective cover 32, the sheet chuck 44 squeezes the sheets 25 and the protective cover 32. In FIG. 7, the rotational pivot 40 turns the sheet chuck 44 to orient the sheets 25 in a state where the protective cover 32 lies on an upper surface of the sheets 25. After the turn, the sheets 25 and the protective cover 32 are supplied to the folding module 34.

In the folding module 34, the arm portion 65 rotates from the position of the phantom line to the position of the solid line. The folding pad 66 pushes the protective cover 32 to fold the pre-bent end portion tightly to the surface of the sheets 25. The covered sheet stack 67 is obtained as combination of the protective cover 32 and the sheets 25. In FIG. 8, the retention pad 68 contacts the upper surface of the covered sheet stack 67 and keeps the protective cover 32 closed. The retention mechanism 69 feeds the covered sheet stack 67 to the bag packaging machine 5. Before feeding the covered sheet stack 67, the plates with the guide ridges 63 are retracted to the inside of the quadrilateral pallet 62.

In the bag packaging machine 5 provided with the covered sheet stack 67 by the covered sheet stack producing device 4, the stack feeding module 71 feeds the covered sheet stack 67 toward the bag-forming/inserting module 72. In FIGS. 8 and 9, the bag-forming/inserting module 72 forms the light-shielding bag material 75 into a tubular shape, the light-shielding bag material 75 including a plastic film overlaid with an aluminum layer. The bag-forming/inserting module 72 causes the light-shielding bag material 75 to wrap the covered sheet stack 67, and simultaneously causes a juncture sealer to weld and close the juncture facets 76*d* of the light-shielding bag material 75 by heat and pressure. Then front and rear ends of the light-shielding bag material 75 are welded and closed by a cross sealer with heat and pressure. Air is sucked out and removed from the packaging bag by an air removing pipe, to package the covered sheet stack 67 in the packaging bag 76 in a tightly sealed state.

In the package finishing module 73, a robot hand grasps a corner of the rear flap 76*a* of the packaging bag 76. The robot hand applies tension to the rear flap 76*a* in two directions, while the flap folding mechanism of a general-purpose type folds it without creating wrinkles. Also, the front flap 76*b* of the packaging bag 76 is folded. The retention mechanism contacts the upper surface of the packaging bag 76 and keeps the rear and front flaps 76*a* and 76*b* closed. Then the sticker 78 is attached to secure the rear and front flaps 76*a* and 76*b* to the packaging bag 76.

In the box packaging machine 6, the box forming module 96 having the general-purpose robot bends the blank sheet 83. See FIG. 10. After bending, the hot-melt gun 84 attaches portions of the blank sheet 83, to obtain the outer box 82.

The box inserting module 80 inserts the guide plate into the outer box 82, and loads it with the packaging bag 76 containing the covered sheet stack 67. Then the lid of the outer box 82 is closed. The sticker 86 is attached. In the box inserting module 80, the lot number and the like are printed to the outer box 82. The image processor is used to inspect the attached state of the sticker, the printed state and the like.

The outer box 82 containing the packaging bag 76 is handled by the cardboard caser, and inserted in an outer packaging cardboard box, which is provided with five outer boxes 82.

In the X-ray film producing system, the slitting device 2, the cutting/stacking device 3, the covered sheet stack producing device 4, the bag packaging machine 5 and the box packaging machine 6 are connected in series, and are balanced in relation to the line capacity balance. Accordingly, it is unnecessary to keep a space for reservation of the material. No complicated administration of materials is required. Any of the modules included in the system has a pallet or base plate having a common size determined in consideration of the expected maximum size of an X-ray film. Each of the modules can be added, removed or exchanged easily according to an amount of production.

In the above embodiment, the sheet package producing system is used in the manufacture of X-ray films. However, sheets to be packaged according to the invention may be photo films, heat sensitive film, photosensitive heat developable films, PPC paper sheets, and any other suitable material of a shape of a film, sheet or plate.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A sheet package producing system for producing a sheet package having a predetermined number of sheets, comprising:

cutting/stacking means for forming said sheets by cutting continuous sheet at a regular length, and for stacking only said individual sheets in said predetermined number directly on a pallet to form stacked sheets;

covered sheet stack producing means for drawing said stacked sheets from said cutting/stacking means, placing a protective cover on said stacked sheets, at least one end portion of said protective cover being bent temporarily, and after placing said protective cover on said stacked sheets, folding said protective cover around at least a portion of said stacked sheets, to obtain a covered sheet stack; and packaging means for packaging one of said covered sheet stack in a packaging bag to obtain said sheet package;

wherein said cutting/stacking means, said covered sheet stack producing means and said packaging means are connected in series with one another.

2. A sheet package producing system as defined in claim 1, wherein said cutting/stacking means, said covered sheet stack producing means and said packaging means are balanced in line capacity balance relative to one another.

3. A sheet package producing system as defined in claim 1, wherein each of said cutting/stacking means, said covered sheet stack producing means and said packaging means includes:

plural modules; and a pallet, disposed in each of said plural modules, having a size predetermined in consideration of a maximum size of said sheets, for supporting said continuous sheet, said sheets, said protective cover, said covered sheet stack or said sheet package.

4. A sheet package producing system for producing a sheet package having a predetermined number of sheets, comprising:

cutting/stacking means for forming said sheets by cutting continuous sheet at a regular length, and for stacking only said individual sheets in said predetermined number directly on a pallet to form stacked sheets;

covered sheet stack producing means for drawing said stacked sheets from said cutting/stacking means, placing a protective cover on said stacked sheets, at least one end portion of said protective cover being bent temporarily, and folding said protective cover around at least a portion of said stacked sheets, to obtain a covered sheet stack; and packaging means for packaging said covered sheet stack in a packaging bag to obtain said sheet package;

wherein said cutting/stacking means, said covered sheet stack producing means and said packaging means are connected in series with one another;

wherein said protective cover includes transversely extending plural bending lines for defining first, second and third portions, said first portion being positioned on an end face of said stacked sheets, said second and third portions being positioned on upper and lower faces of said stacked sheets; and wherein said covered sheet stack producing means includes:

folding means for folding said protective cover along said plural bending lines, and for squeezing said stacked sheets between said second and third portions, to obtain said covered sheet stack.

5. A sheet package producing system as defined in claim 4, wherein said cutting/stacking means includes:

supply means for feeding said continuous sheet;

cutter means for cutting said continuous sheet to obtain said sheets; and stacker means for stacking said sheets in said predetermined number.

6. A sheet package producing system as defined in claim 5, wherein said first handling means places said second portion of said protective cover on said stacked sheets;

further comprising second handling means for turning over a sheet orientation of said stacked sheets to locate said protective cover under said stacked sheets, and then for setting said protective cover and said stacked sheets to said folding means;

said folding means folds said protective cover by bending upward said third portion.

7. A sheet package producing system as defined in claim 6, wherein said cutting/stacking means further includes synchronizing means for synchronizing said supply means, said cutter means and said stacker means with one another.

8. A sheet package producing system as defined in claim 7, wherein said supply means, said cutter means and said stacker means include respectively drive power sources;

said synchronizing means electrically synchronizes said drive power sources.

9. A sheet package producing system as defined in claim 7, wherein said cutting/stacking means further includes:

a drive power source incorporated in one of said supply means, said cutter means and said stacker means; and two transmission couplings for transmitting force of driving of said drive power source to remaining two of said supply means, said cutter means and said stacker means, to constitute said synchronizing means.

10. A sheet package producing system as defined in claim 9, wherein said drive power source is incorporated in said cutter means.

11. A sheet package producing system as defined in claim 6, wherein said covered sheet stack producing means further includes pre-bending means, actuated earlier than said folding means, for bending said protective cover temporarily by forcibly depressing said third portion;

said first handling means sets said protective cover on said pre-bending means, and then places said protective cover on said stacked sheets.

12. A sheet package producing system as defined in claim 11, wherein said second handling means includes:

sheet chuck means for capturing said stacked sheets;

moving robot arm means for moving said sheet chuck means; and rotating means, secured to said sheet chuck or said moving robot arm means, for rotating said sheet chuck means to turn over said sheet orientation.

13. A sheet package producing system as defined in claim 12, wherein said first handling means includes:

cover suction pad means for sucking said protective cover;

cover moving robot arm means for moving said cover suction pad means.

14. A sheet package producing system as defined in claim 6, wherein said packaging means includes:

bag packaging means for packaging said covered sheet stack in a packaging bag;

box packaging means for packaging said covered sheet stack in an outer box after packaging in said packaging bag, to obtain said sheet package.

15. A sheet package producing system as defined in claim 14, wherein said bag packaging means includes:

stack feeding means for feeding said covered sheet stack;

first means for wrapping said covered sheet stack with bag material; and second means for folding a margin flap of said bag material wrapping said covered sheet stack, to form enclosure of said covered sheet stack in said packaging bag.

16. A sheet package producing system as defined in claim 15, wherein said box packaging means includes:

box forming means for forming said outer box by bending a plate material or sheet material; and box inserting means for inserting said covered sheet stack into said outer box after packaging in said packaging bag.

17. A sheet package producing system as defined in claim 6, wherein said cutting/stacking means further includes decurler means for eliminating or reducing a curling tendency of said continuous sheet.

* * * * *